US006078635A

United States Patent [19]

DuBois

[11] Patent Number: 6,078,635

[45] Date of Patent: Jun. 20, 2000

[54] SEED OR PARTICLE-COUNTING DEVICE

[76] Inventor: Jerry DuBois, 3429 Valley View Dr., WDM, Iowa 50265

[21] Appl. No.: 09/018,908

[22] Filed: Feb. 5, 1998

[51] Int. Cl.[7] ..... G06M 3/00

[52] U.S. Cl. ..... 377/6; 377/2

[58] Field of Search ..... 377/2, 6

[56] References Cited

U.S. PATENT DOCUMENTS

| | | | |
|---|---|---|---|
| 3,964,639 | 6/1976 | Norris et al. | 221/278 |
| 4,057,709 | 11/1977 | Lyngsgaard et al. | 377/6 |
| 4,392,439 | 7/1983 | Herriau | 111/34 |
| 4,475,819 | 10/1984 | Balmer | 366/107 |
| 4,616,577 | 10/1986 | Van Der Lely | 111/1 |
| 4,881,237 | 11/1989 | Donnelly | 372/50 |
| 4,928,607 | 5/1990 | Luigi | 111/185 |
| 5,161,473 | 11/1992 | Landphair et al. | 111/176 |
| 5,501,366 | 3/1996 | Fiorido | 221/211 |
| 5,533,458 | 7/1996 | Bergland et al. | 111/200 |
| 5,565,985 | 10/1996 | Fishkin et al. | 356/339 |
| 5,635,911 | 6/1997 | Landers et al. | 377/6 |

*Primary Examiner*—Margaret R. Wambach
*Attorney, Agent, or Firm*—Zarley, McKee, Thomite, Voorhees & Seas

[57] ABSTRACT

A seed counter of the present invention is used to accurately count seeds at a high speed. The invention includes a line vac connected to a linear array laser. The line vac is connected to a supply of seeds which are drawn through the line vac by a source of pressurized air and past the photoelectric sensor. The photoelectric sensor is connected to a control circuit which counts the seeds as they pass the photoelectric sensor. The control circuit also controls the flow rate of the counter by means of a variable pressure regulator connected to the line vac. As a result, the flow rate of the counter can be precisely controlled and a precise number of seeds can be counted and conveyed by the invention.

11 Claims, 2 Drawing Sheets

SEED OR PARTICLE-COUNTING DEVICE

BACKGROUND OF THE INVENTION

1. Field of the Invention

The present invention relates to seed handling and packaging. More particularly, though not exclusively, the present invention relates to a method and apparatus for accurately counting and controlling the flow rate of seeds.

2. Problems in the Art

Traditionally, seed corn is purchased using weight as the means for measuring the amount of product packaged in a particular package. Since seeds typically vary in size and shape, it is very difficult to get a desired number of seeds per package using weight. Seed corn manufacturers therefore typically supply a small amount of extra product in each package in order to insure that the customer is not shorted. This extra product amount to a large amount of waste in a production situation. In some circumstances, seed is required to be sorted according to size. This requires that the seed be fed at a precise flow rate. This is difficult because of the nonuniform nature of seed shape and size.

3. Features of the Invention

A general feature of the present invention is the provision of a method and apparatus for counting and controlling the flow rate of seeds which overcomes problems found in the prior art.

A further feature of the present invention is the provision of a method and apparatus for counting and controlling the flow rate of seeds using a line vacuum in combination with a photoelectric beam to count seeds as they flow past the photoelectric beam.

Further features, objects and advantages of the present invention include:

A method and apparatus for counting and controlling the flow rate of seeds which uses a source of compressed air, a variable pressure regulator, and a control circuit to precisely control the flow of seeds.

A method and apparatus for counting seeds which uses a counter connected to a photoelectric beam for sensing and counting seeds as they pass through the photoelectric beam.

A method and apparatus for counting and controlling the flow rate of seeds which uses a feedback from the control circuit to the variable pressure regulator to control the flow rate to a desired target rate.

A method and apparatus for counting and controlling the flow rate of seeds which uses a line vac connected by a hose to a source of seeds, and a seed strainer to help prevent the line vac from getting clogged.

A method and apparatus for counting and controlling the flow rate of seeds which using a photoelectric beam which spans the entire diameter of the conveyor hose.

These, as well as other features, objects and advantages of the present invention will become apparent from the following specification and claims.

SUMMARY OF THE INVENTION

The seed conveying and counting apparatus and method of the present invention is used to count seeds passing through the apparatus. The invention includes a photoelectric sensor placed in line with the flow of seeds through the invention for counting the number of seeds passing the photoelectric sensor. The seeds are preferably drawn from a seed supply via a line vac powered by a source of pressurized air. In the preferred embodiment, a control circuit counts the seeds sensed by the photoelectric sensor and also controls the seed flow rate via a variable pressure regulator.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalencies which may be included within the spirit and scope of the invention.

Figure 1:
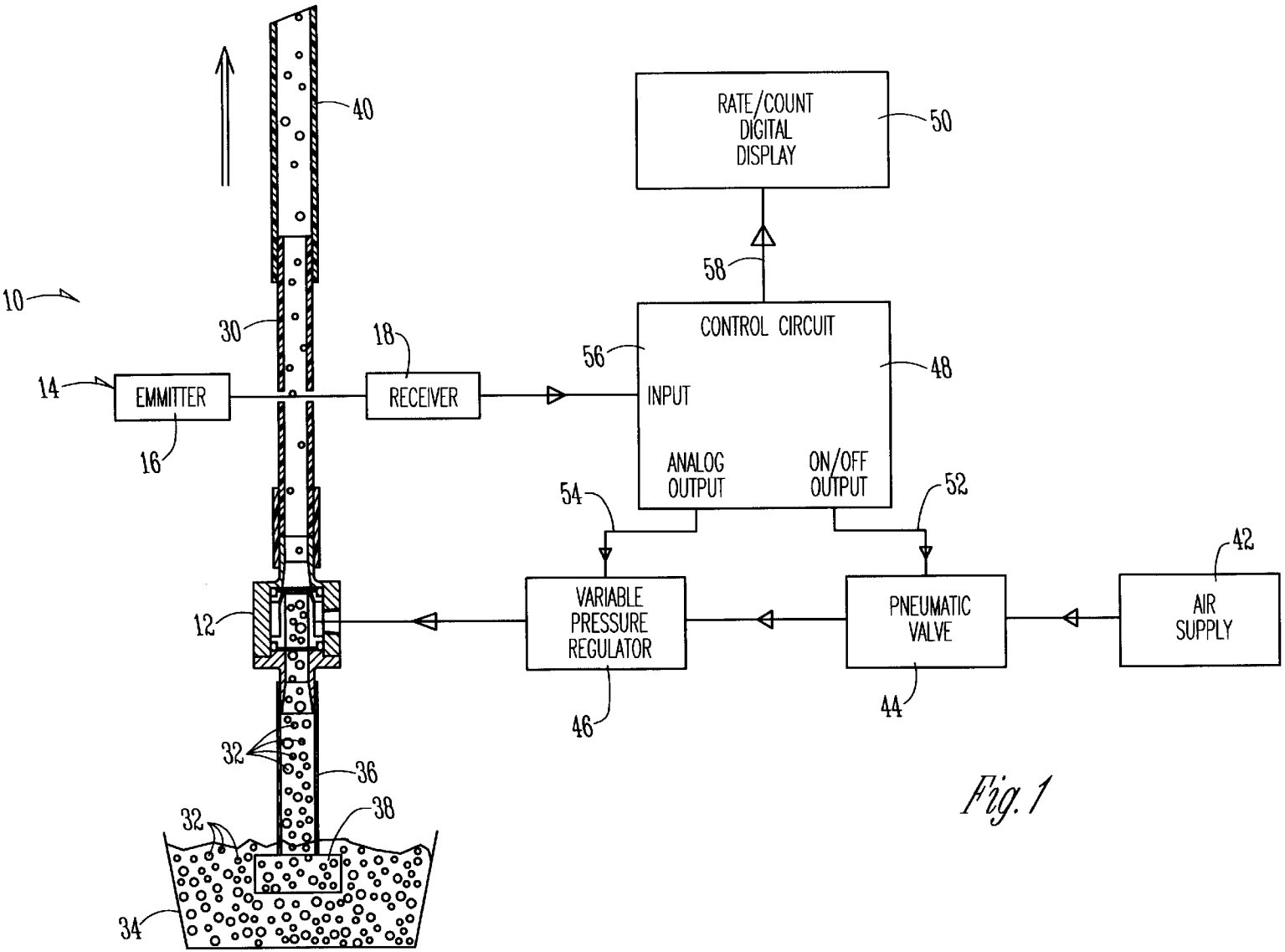
FIG. 1 is a diagram of the present invention.

FIG. 1 is a diagram of the present invention. FIG. 1 shows a seed counter 10 being used to count seeds. The seed counter 10 is comprised of a line vac 12 used in combination with a photoelectric sensor 14. The photoelectric sensor includes an emitter 16 and a receiver 18.

Figure 2:
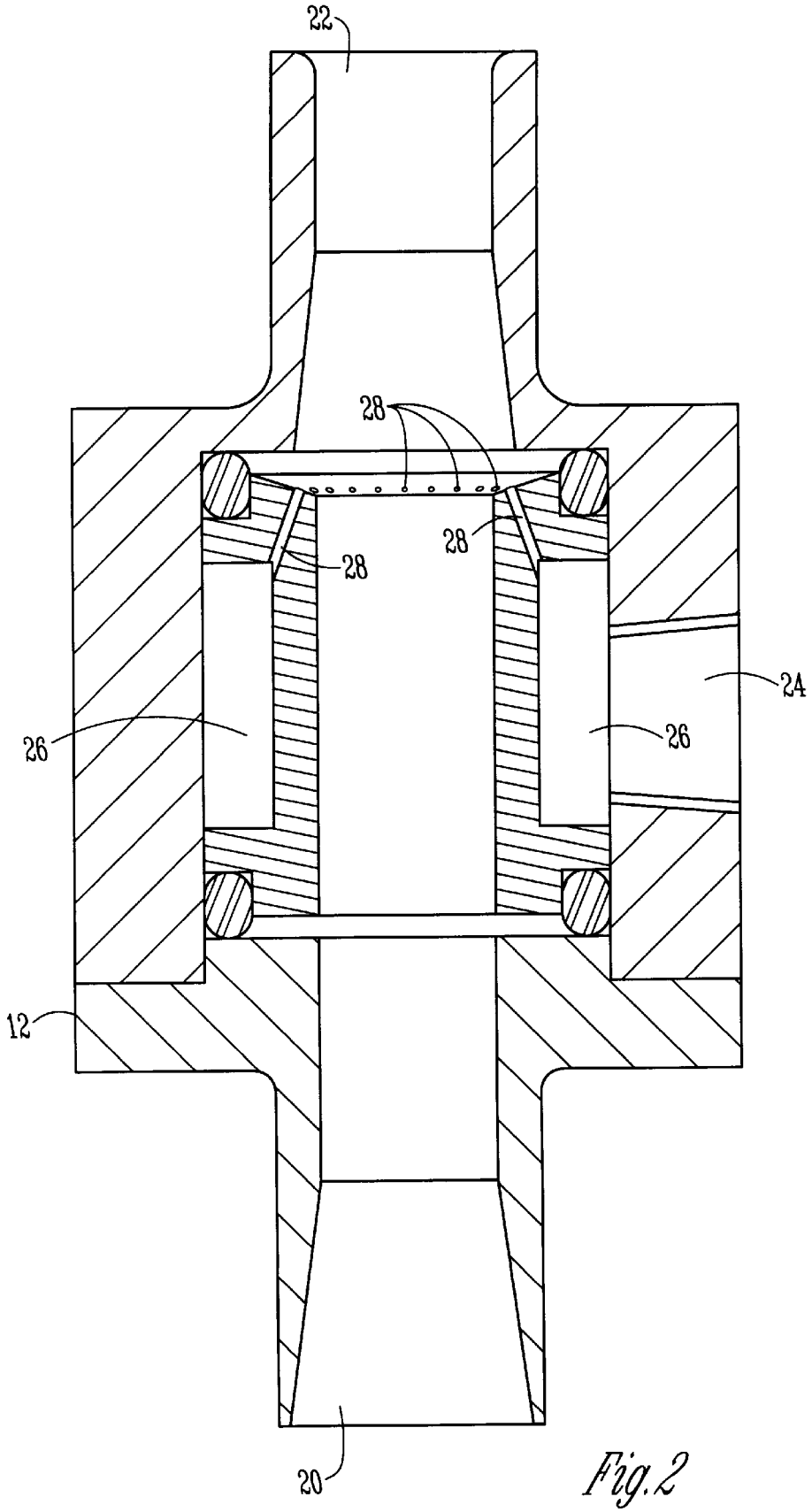
FIG. 2 is an enlarged view of the line vac shown in FIG. 1.

The line vac 12 is shown in detail in FIG. 2. The line vac 12 has an input port 20 and an output port 22. The line vac 12 also includes a supply port 24 which is connected to a source of compressed air. In communication with the supply port 24 is an annular plenum chamber 26. Disposed around the upper end of the plenum chamber 26 are a plurality of nozzles 28 as shown. When compressed air is introduced into the plenum chamber 26, the air is forced up into the throat of the line vac 12 through the system of nozzles 28. These jets or nozzles 28 create a vacuum at the intake port 20 of the line vac 12 which will draw seeds through the line vac 12 as described in detail below. The line vac 12 is an off-the-shelf unit. One suitable line vac is the model 6080 manufactured by EXAIR.

The photoelectric sensor 14 is also an off-the-shelf item. In the preferred embodiment, the photoelectric sensor 14 is comprised of a laser emitter 16 and receiver 18. One suitable photoelectric sensor is the model LA511 linear array laser manufactured by SUNX. In the preferred embodiment, the emitter 16 creates a "sheet" of light which spans the entire diameter of a half inch quartz tube 30. The preferred photoelectric sensor 14 is capable of not only determining when an object passes between the emitter 16 and the receiver 18, but can also determine the size of the object. Other alternate types of sensors could also be used with the present invention.

In its preferred embodiment, the seed counter 10 is used to count seeds 32 drawn from a bulk seed container or seed supply 34. The input port 20 of the line vac 12 is connected to a tube 36 having a seed strainer 38 covering the end of the tube 36. The end of the tube 36 and the strainer 38 are disposed within the seed supply 34. The quartz tube 30 is connected to a third tube 40 which may be connected to a bagging device or bin, for example.

The supply port 24 of the line vac 12 is connected to a supply of compressed air 42. In order to control the amount of air blown through the line vac 12, a pneumatic valve 44 and variable pressure regulator 46 are connected in series between the air supply 42 and the line vac 12 as shown in FIG. 1. The pneumatic valve 44 and variable pressure regulator 46 are each electrically connected to a control circuit 48 which will be described in more detail below. The control circuit 48 is also electrically connected to the photoelectric sensor 14 and to a rate/count digital display 50. All or some of the components of the seed counter 10 may be enclosed within a housing. Also, the seed counter 10 of the present invention has a long operating life since there are not moving parts.

A user of the seed counter 10 can control the operation of the counter 10 by means of the control circuit 48. To turn the air supply to the line vac 12 on or off, an on/off output connection 52 is made between the control circuit 48 and pneumatic valve 44. To control the rate at which the seed counter 12 operates, the variable pressure regulator 46 can be controlled by means of the analog input connection 54. The signal sent to the regulator 46 is preferably a 0-10 VDC analog signal. As more air is allowed to flow into the line vac 12 via the pressure regulator 46, the faster the seeds 32 will be drawn through the line vac 12 and past the photoelectric sensor 14.

The photoelectric sensor 14 is connected to the control circuit 48 by an input connection 56. When a seed or other object passes through the beam of light between the emitter 16 and receiver 18, an electrical signal will be sent to the control circuit 48 via the input connection 56. The sensed seeds can be counted, and a flow rate can be determined. The control circuit 48 is connected to the display 50 by a control circuit connection 58.

The present invention operates as follows. First, a user enters a desired flow rate into the control circuit 48. Alternatively, a default flow rate can be used. With the seed strainer 38 placed within a supply of seeds 34, a start switch is switched and the pneumatic valve 44 is turned on via the control circuit 48. This allows a supply of compressed air from the air supply 42 to pass through the variable pressure regulator 46 and into the line vac 12. The compressed air then enters the plenum chamber 26 and is injected up through the nozzles 28 creating a vacuum at the input port 20 of the line vac 12. This vacuum draws seeds 32 through the seed strainer 38 and into the tube 36. When the seeds approach the nozzles 28, the velocity of the seeds dramatically increases, spreading the seeds apart as shown in FIG. 1 so that the seeds counted by the photoelectric sensor 14 are counted individually, as shown in FIG. 1. As the seeds flow through the tube 30 and pass between the emitter 16 and receiver 18, the "sheet" of light will temporarily be broken by the seed. The receiver 18 will sense the seed breaking the beam of light and will send a signal to the control circuit 48 via the input connection 56. The control circuit 48 includes a counter which counts the signals received from the receiver. In this way, the number of seeds passing the beam of light are accurately counted. As mentioned above, the preferred photoelectric sensor 14 is capable of determining the size of the object passing through the beam of light as a result of the sensitivity of the photoelectric sensor 14. As a result, the control circuit is capable of distinguishing between a seed 32 and a foreign object such as dirt of chaff. Therefore, these foreign objects will not be counted by the control circuit 48. The number of seeds counted can be displayed on the digital display 50. Also, the seeds may be batch counted because of the precise pressure control.

The rate at which the seeds are pushed through the tubes can be controlled by controlling the variable pressure regulator 46. The signal from a receiver 18 can act as a feedback signal so the control circuit 48 will know whether to increase or decrease the air pressure into the line vac 12 to achieve a desired rate. This accurate seed flow is maintained due to the PID loop process control method. In addition, if the seed counter 10 is used to fill a bag, a nearly exact number of seeds can be placed within the bag. For example, seed corn is commonly sold in bags of 80,000 seeds per bag. As the number of seeds counted approaches 80,000, the control circuit can reduce the air pressure and slow down the flow rate so that the flow of seeds can be more precisely stopped when the bag has 80,000 seeds.

The seed counter 10 operates without damaging the seeds in any way. In addition, seeds having different sizes can be transferred without clogging or requiring adjustment to the system. The seeds can be fed through the counter 10 at any desired rate based on the count, rather than the weight. In the preferred embodiment, the seed counter 10 is capable of counting at high rates of speeds, even as high as 250 seeds per second.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. An apparatus for conveying and counting seeds comprising:

a tube in communication with a supply of seeds to be counted; p1 a seed strainer coupled to an end of the tube to strain the seeds drawn into the tube;

a linear array laser operating as a photoelectric sensor in communication with the tube, the photoelectric sensor producing an electrical signal in response to objects passing the photoelectric sensor and determining the size of the object;

a counter electrically connected to the photoelectric sensor; and a line vac operatively coupled to the tube for drawing seeds into the tube and past the photoelectric sensor, wherein seeds passing the photoelectric sensor are counted by the counter.

2. The apparatus of claim 1 wherein the line vac uses compressed air to draw the seeds into the tube and pass the photoelectric sensor.

3. The apparatus of claim 2 further comprising a variable pressure regulator operatively connected to the line vac for controlling the rate at which the seeds are drawn into the tube.

4. The apparatus of claim 1 further comprising a rate/count digital display unit for displaying the number of seeds counted.

5. The apparatus of claim 1 further comprising a control circuit operatively connected to the photoelectric sensor, a digital display, a pre-pneumatic valve, and a variable pressure regulator.

6. The apparatus of claim 5 wherein the control circuit controls the pnematic valve and variable pressure regulator in order to control the rate at which seeds are drawn into the tube.

7. The apparatus of claim 5 wherein the control circuit determines a seed flow rate based on the seeds counted by the photoelectric sensor, and wherein the variable pressure regulator is controlled based on a determined rate, fed to a PID loop process control method.

8. A method of conveying and counting seeds comprising the steps of:

providing a tube network extending from a source of seeds;

straining the seeds before they are moved through the tube network;

placing a photoelectric sensor in line with the tube network;

moving seeds through the tube network using a lineback and past the photoelectric sensor; and sensing the seeds as they pass the linear array laser.

using the sensing information to count the sensed seeds;

displaying information based on the sense seeds passing the photoelectric sensor;

controlling the rate at which the seeds are moved through the tube network based on a desired rate and the sensed seeds;

filling a container with the seeds moved through the tube network with a desired number of seeds;

filling the container with a first batch of seeds at a set flow rate.

9. The method of claim 8 further comprising the step of determining a flow rate by accurately counting the seeds passing through the tube network based on the sensed seeds.

10. The method of claim 9 further comprising the step of controlling the rate at which the seeds are moved through the tube network by monitoring the determined rate using a PID loop process control method.

11. The method of claim 8 further comprising the steps of:

filling the container with a second batch of seeds at a second rate, wherein the second rate is less than the first rate, and wherein the first and second batch of seeds approximately totals the desired number of seeds.

* * * * *